US008684074B2

(12) United States Patent
Atkins et al.

(10) Patent No.: US 8,684,074 B2
(45) Date of Patent: Apr. 1, 2014

(54) WORK STRING MOUNTED CLEANING TOOL AND ASSEMBLY METHOD

(75) Inventors: James Edward Atkins, Aberdeenshire (GB); James Linklater, Banffshire (GB); George Telfer, Aberdeen (GB)

(73) Assignee: Specialized Petroleum Services Group Limited, Aberdeen (GB)

( * ) Notice: Subject to any disclaimer, the term of this patent is extended or adjusted under 35 U.S.C. 154(b) by 368 days.

(21) Appl. No.: 13/125,241

(22) PCT Filed: Oct. 23, 2009

(86) PCT No.: PCT/GB2009/051430

§ 371 (c)(1), (2), (4) Date: Apr. 20, 2011

(87) PCT Pub. No.: WO2010/049723

PCT Pub. Date: May 6, 2010

(65) Prior Publication Data

US 2011/0203063 A1 Aug. 25, 2011

(30) Foreign Application Priority Data

Oct. 27, 2008 (GB) ..... 0819671.9

(51) Int. Cl.
*E21B 37/00* (2006.01)

(52) U.S. Cl.
USPC ..... 166/173

(58) Field of Classification Search
USPC ..... 166/311, 380, 170, 173
See application file for complete search history.

(56) References Cited

U.S. PATENT DOCUMENTS

| | | | | |
|---|---|---|---|---|
| 2,713,913 A | | 7/1955 | Ragan | |
| 2,845,129 A | * | 7/1958 | Baker | 166/173 |
| 4,798,246 A | | 1/1989 | Best | |
| 5,711,046 A | * | 1/1998 | Potter | 15/104.2 |
| 6,464,010 B1 | | 10/2002 | Brown | |
| 8,368,256 B2 | * | 2/2013 | Yoo et al. | 310/12.16 |
| 2007/0261855 A1 | * | 11/2007 | Brunet et al. | 166/312 |

FOREIGN PATENT DOCUMENTS

| | | |
|---|---|---|
| GB | 2 338 734 A | 12/1999 |
| GB | 2 424 235 A | 9/2006 |
| WO | 98/37305 A1 | 8/1998 |
| WO | 2006/016102 A1 | 2/2006 |
| WO | 2006/097710 A1 | 9/2006 |

OTHER PUBLICATIONS

International Search Report from PCT/GB2009/051430 dated Mar. 22, 2010 (2 pages).
Written Opinion from PCT/GB2009/051430 dated Mar. 22, 2010 (7 pages).
Search Report for Application No. GB0819671.9 dated Jan. 6, 2009 (2 pages).

* cited by examiner

*Primary Examiner* — William P Neuder
(74) *Attorney, Agent, or Firm* — Osha Liang LLP

(57) ABSTRACT

Work string-mounted cleaning tool and a method of assembling such tools using a quick release for the cleaning element. Oblong pad element has a curved upper surface with slots to receive work surface segments. Opposite edge has a part-circular recess with part-circular peripheral lip around an upper edge of the recess. A retainer fastening component in the recess has a core with socket adapted to receive a driving tool. The retainer is sized to permit it to rotate when mounted within the recess. Roll pins are provided for use in locating the fastener component in predetermined rotational configurations in relation to the recess. Shear pin is provided to inhibit unintended rotation of the fastener component, and to lock the retainer for normal use of the cleaning tool. Shearing of the shear pin permits disassembly of the tool.

12 Claims, 15 Drawing Sheets

WORK STRING MOUNTED CLEANING TOOL AND ASSEMBLY METHOD

FIELD OF THE INVENTION

The present invention relates to a cleaning tool for use in a borehole and provides work string mounted tools and a method of assembling tools for cleaning the borehole. In particular, the present invention relates to a means for releasably attaching at least one cleaning element to a cleaning tool.

BACKGROUND TO THE INVENTION

In the drilling and production of oil and gas wells, a well bore is drilled by means of a plurality of drill pipes provided in sufficient numbers to assemble a rotatable drill string sufficient to drill the required depth. The rotatable drill string is terminated by a drill bit and typically provided with stand-off stabiliser parts periodically throughout the length of the drill string. The drill string is rotated to remove formation ahead of the drill bit, to drill out and thus form a wellbore, and to increase the depth of the well. Drilling mud or other fluid is circulated through the drill string to cool, lubricate and clear the drill bit of cuttings, and to displace the resulting drill cuttings from the bottom of the well to the surface, via an annulus formed between the drill string and the wall of the wellbore.

Periodically, the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

The step of cleaning the wellbore is usually achieved by inserting a work string containing dedicated well clean-up or cleaning tools or subs. Typical well cleaning tools known for use in this environment include scrapers, wipers and/or brushes which are held against the internal wall of the casing/liner, to clean away debris as the tool is run-in and then pulled out of the wellbore.

After a number of cleaning operations have been conducted, the cleaning elements, e.g. scrapers or bristles, can become worn, contaminated, clogged with debris and detritus, or otherwise deteriorated from design functionality. Therefore, when the work string is pulled out of hole, the cleaning sub tool requires servicing and the cleaning elements replaced or remediated. This normally entails break out of the tool sub from the string, and dismantling of the tool. This activity requires technically skilled labour to ensure that the tool is correctly assembled e.g. correct torque settings are applied; involves risk of error or potential damage to the tool e.g. fastener thread stripping; and also takes the tool out of action for the inevitable downtime associated with shipping back to the workshop for the aforesaid redressing operations.

It is amongst the objects of at least one embodiment of the present invention to obviate or mitigate at least one of the foregoing disadvantages.

SUMMARY OF THE INVENTION

According to a first aspect of the present invention, there is provided a tool body adapted to receive a cleaning element, a cleaning element configured to be mounted upon the tool body, and a quick-release fastening comprising a movable fastener component for retaining the cleaning element upon the tool body and at least one press-fit fastener for holding the movable fastener component in a predetermined position.

Providing a movable fastener component that can be moved laterally relative to the tool body in such a way that the cleaning element can be retained or released selectively avoids use of screw fasteners, and the need to be concerned about torque settings.

Preferably the movable fastener component is configured to provide a projection that is insertable into a corresponding recess to provide restraint to movement of the cleaning element when properly positioned with respect to the tool body.

Conveniently, the cleaning element is a removable pad with an obverse working surface and a reverse mounting surface.

An edge of the pad is preferably adapted for connecting with a corresponding part of the tool body by suitable alignment and contact.

An opposite edge of the pad is preferably adapted to receive the movable fastener component. The preferred movement is a rotation in a plane aligned with the breadth of the pad. Thus a projection upon the movable component may be concealed within a recess in the pad, or turned outwardly to project from the pad. Such a projection can be used to engage a corresponding aperture or slot in the tool body to provide restriction to movement of the pad due to contact between the projection and the aperture or slot interfering with and inhibiting relative movement of the pad with respect to the tool body.

Such an arrangement allows swift removal and replacement of cleaning element modules when the tool is being serviced. Thus the tool can be redressed in the field without dismantling the complete tool.

According to a second aspect of the present invention, there is provided a tool body adapted to receive a cleaning element, a cleaning element configured to be mounted upon the tool body, and a quick-release fastening comprising a movable fastener component for retaining the cleaning element upon the tool body and a shearable fastener for holding the movable fastener component in position, wherein the movable fastener component is adapted to shear the shearable fastener for release of the cleaning element.

This arrangement provides for secure positioning and control of the fastening and release of the cleaning element from the tool body, and avoids accidental release of the cleaning element prematurely.

A suitable quick-release fastening comprises an asymmetric fastener component that has a shape that provides for at least two configurations when positioned with the cleaning element, such that in a first configuration, an edge of the component projects from the cleaning element, and in another configuration that edge does not project from the cleaning element.

The cleaning element may be provided with a recess for receiving the fastener component such that in a first configuration an edge of the fastener component projects out of the recess, and in the second configuration that edge of the fastener component lies within the recess.

The fastener component may be conveniently mounted for rotation within the recess, so that by appropriate rotation of the component a projecting edge of the fastener component may be caused to emerge from or retreat within the recess.

A rotational mounting feature is more convenient than a sliding capability since it admits use of a readily available driving tool and permits a reliable and predictable functionality.

The positioning of the fastener component with respect to the cleaning element suitably permits the former to be selectively retained in a predetermined configuration such as with the edge concealed within or projecting from the recess of the cleaning element by use of retaining means such as one or more removable roll pins.

The positioning of the fastener component may be locked in a functional position by use of the shear fastener to inhibit movement of the fastener component by way of an interference or contact fit therewith, for example by passing through the upper surface of the cleaning element through an aperture in the fastener component and into the tool body.

The cleaning element may be configured to have an edge portion remote from the quick release fastening that is adapted to form an inter-fit with a corresponding part of the tool body. A "tongue and groove"-type edge fixing configuration is suitable, conveniently with a tongue being formed on the cleaning element, and a corresponding groove being formed in the tool body for ease of juxtapositioning of the one with respect to the other.

Whilst it is possible to reverse that arrangement, the preferred arrangement described herein offers significant operational advantages over the other arrangement where the recessed component is situated in the tool body part.

The cleaning element may be dimensioned such that it has a length greater than its breadth.

At least one work surface of the cleaning element may be curved e.g. to conform to an external surface of the tool body which may be a sub attached within the length of a tubular work string.

The work surface may comprise replaceable segments.

The work surface of the cleaning element may be one that is adapted to scrape, scour, swab, wipe, brush or offer a combination of such functionalities.

Preferred working surfaces comprise scraper blades or bristles.

According to a further aspect of the invention there is provided a method of assembling a cleaning tool adapted for use downhole, comprising: providing a tool body adapted to receive at least one removable cleaning element, providing a removable cleaning element and applying to the element a quick release fastening comprising a fastener component adapted to adopt at least two configurations when positioned with the cleaning element whereby an edge of the component either projects from the cleaning element, or does not project from the cleaning element, arranging the fastener component into a configuration in which that edge does not project from the cleaning element inserting the removable element into the tool body by presenting an edge of the element to the body and forming an inter-fitting engagement with the tool body, seating the element upon the tool body, moving the fastener component to a configuration in which the projecting edge of the fastener component forms an inter-fitting engagement with the tool body, and inserting a shear fastener to inhibit further movement of the fastener component.

The method may include provision of roll pins to facilitate positioning of the fastener component in an appropriate selected configuration in the edge of the cleaning element.

The fastener component for use in this invention is preferably adapted to shear the shear fastener when it is intended to remove the cleaning element from the tool body. This is achievable by adapting the fastener component to receive a driving tool e.g. by providing a socket in the fastener for receiving a polygonal pin key tool, or slots for receiving a blade or cross-head driving tool.

The fastener component may comprise a generally cylindrical core with a flange extending radially outwards to define a portion adapted to engage a recess when properly oriented and presented to such a recess in the tool body. The purpose of the flange portion is to form means for penetrating and interfitting with such a recess whereby the cleaning element may not be lifted out of its proper seating position in the tool body whilst the flange portion is engaged in the recess in the tool body.

The peripheral edge of the fastener component is preferably configured to provide mutually spaced end stop recesses for engaging positioning means such as roll pins whereby the displacement of the fastener component from a selected position with respect to the cleaning element is limited, preferably by providing a fixed orientation where the fastener component once oriented to its selected position is locked into that position by insertion of the roll pins.

A further portion of the peripheral edge of the fastener component is adapted to provide means for shearing a shear fastener when driven against same e.g. by use of a driving tool.

The preferred implementation of the fastener component provides for a rotational mounting thereof in the cleaning element whereby turning of the fastener component by a driving tool causes the portion providing means for shearing to abut the shear fastener and application of further turning force by the driving tool causes the shear fastener to yield as designed and thereby free the fastener component for turning out of the recess in the tool body and allowing the cleaning element to be lifted out of its seated position.

The method of the invention, to be more particularly described with reference to the accompanying drawings hereinbelow thereby provides a way of securely retaining cleaning elements e.g. replaceable pads, in a releasable way that permits re-dressing of the tool in the field.

The preferred releasable fastening of the invention that has a keying component operable between a projecting fastening configuration, and a recessed releasing configuration, retained in position by a shearable fastener, and that relies upon no threaded fasteners offers a tamper-proof fastening that is reliably and easily checked in the field without torque testing etc.

The shear fastener can be forced to yield by use of a suitable driving tool, and thus provides greater certainty that a tool has been assembled to spec. yet also allows rapid on-site redressing capability using replacement pads with new shear fasteners.

The use of roll pins in appropriate sequence when positioning the fastening component in the selected configuration also provides a simple and quick assembly/disassembly means.

A downhole tool in which the invention may be implemented is suitably a one-piece sub body adapted to be connected to a tubular workstring, the body being provided with non-rotating stabiliser sleeves and a non-rotating lantern adapted for scraping or brushing The cleaning steps may be conducted as normal whilst the drill string is being reciprocated within the wellbore. Optionally, the cleaning steps may be repeated whilst the rotating drill string is reciprocated at a controlled rate.

A suitable arrangement of the cleaning elements would be to provide a plurality of mutually spaced replaceable pads of bristles (or scraper blades) in radially spaced circumferential array around a tubular tool body which offers good cleaning functionality without inhibiting external fluid circulation past the tool.

BRIEF DESCRIPTION OF THE DRAWINGS

Embodiments of the present invention will now be described, by way of example only, with reference to the accompanying drawings, in which.

Modes FOR CARRYING OUT THE INVENTION

Figure 1:
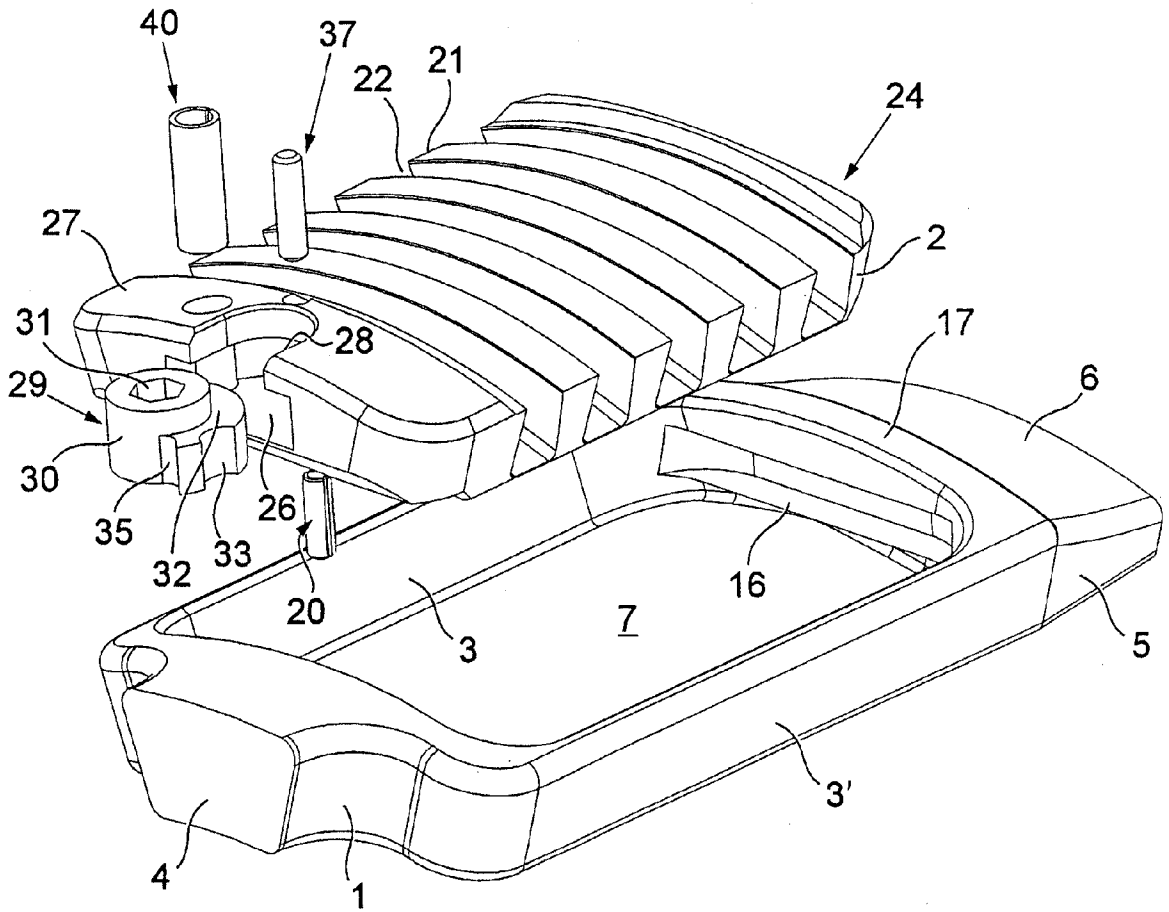
FIG. 1 is an exploded perspective view from above and to one side of a cleaning element body, cleaning element juxtaposed for insertion therein and quick release fastening components including roll pins and a shear fastener pin presented for retention thereof.
Figure 2:
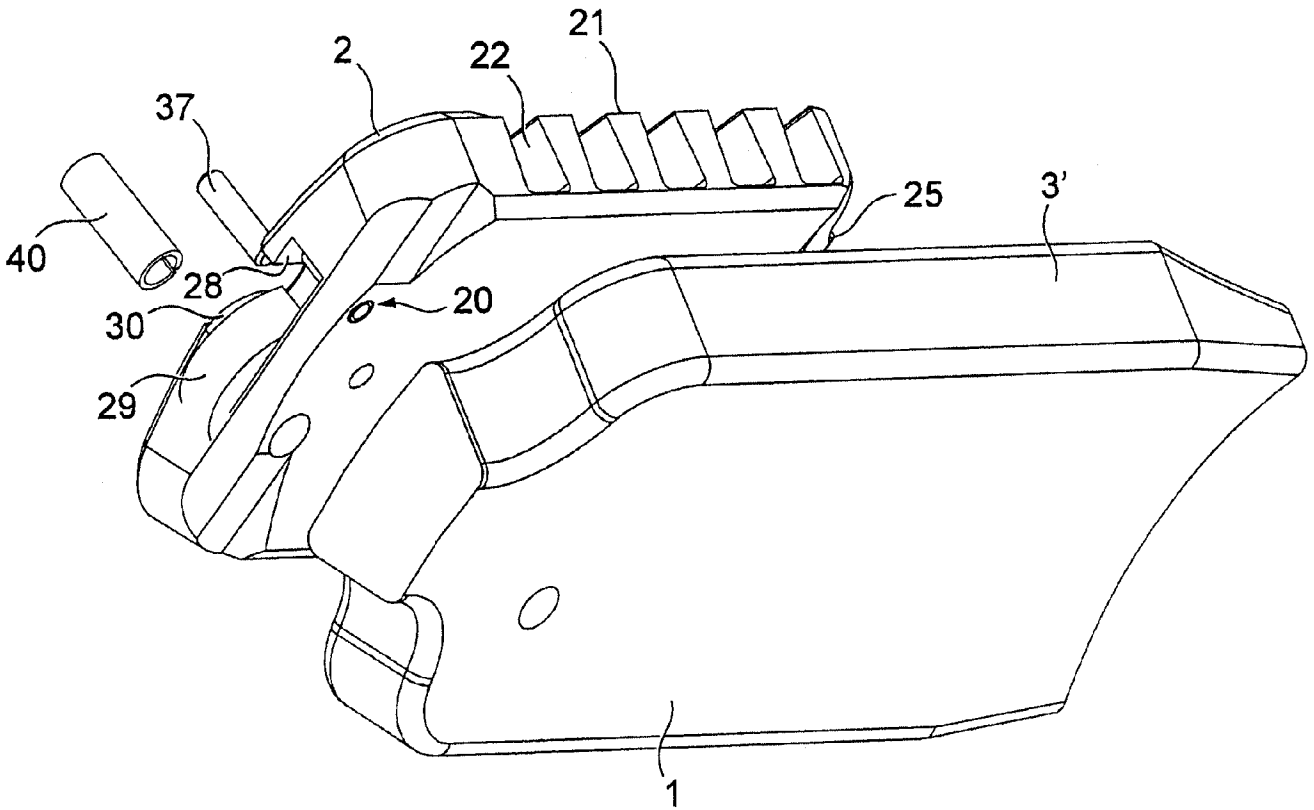
FIG. 2 is an exploded perspective view from below and to one side of the cleaning element of FIG. 1 in a first stage of assembly of the quick release fastening thereto, particularly showing a first roll pin inserted into a hole in the bottom of the cleaning element.

Brush Pad Lantern Cleaning Tool Sub Assembly:

Referring to FIGS. 1 to 4, a body 1 for receiving a brush pad cleaning element 2 has opposed parallel sidewalls 3, 3' and contoured ends 4, 5, with an inclined surface 6 and an opening 7 within the body 1 to receive brush pad cleaning element 2.

Cleaning element 2 is an oblong element of curved longitudinal cross-section, and having an upper surface 21 with slots 22 adapted to receive by insertion work surface segments of various types, e.g. carrying bristles to assemble a brush type cleaning element 23.

A shorter dimension edge 24 of the cleaning element 2 provides tongue 25 for insertion into a corresponding groove 16 in an end wall 17 (within the opening 7) in the body 1.

An opposite edge 27 of the cleaning element 2 has a part-circular recess 26 with part-circular peripheral lip 28 around an upper edge of the recess 26, the said recess being of a shape (e.g. accessible via an inverted T-shaped aperture) suited to receive a component of first and second width dimensions wherein the first width dimension can be accommodated within the full width of the recess but is greater than the width of the headspace within the lip 28, and the second width dimension can be accommodated within the headspace within the lip 28.

An asymmetric fastener component 29 adapted to be positioned in the recess 26 as a retainer piece to allow the cleaning element 2 to be held in the opening 7 of the body 1, has a core 30 with socket 31 adapted to receive a hexagonal driving tool (not shown). The core 30 has a flange 32 extending part way around it, and the flange 32 has concave curved surfaces 33 and 34 spaced one from the other at substantially diametrically opposed locations, and adjacent to the curved surface 34, end portion 35 presents a further concave surface 36 for reasons to be explained below.

The fastener component 29 is sized to permit it to rotate when mounted within the part-circular recess 26, and when turned by a driving tool to present at least part of the flange 32 projecting out of the recess to serve as a means of forming an inter-fitting engagement with a groove 19 in a corresponding end wall 18 of the body 1.

Roll pins 20 and 40 are provided for use in locating the fastener component 29 in predetermined rotational configurations in relation to the recess 26.

Shear pin 37 is provided to inhibit unintended rotation of the fastener component 29 from a predetermined position set by location of the roll pins, and to lock the fastener component 29 in a retaining configuration for normal use of the cleaning tool, even if a roll pin is lost from the assembly.

Figure 4:
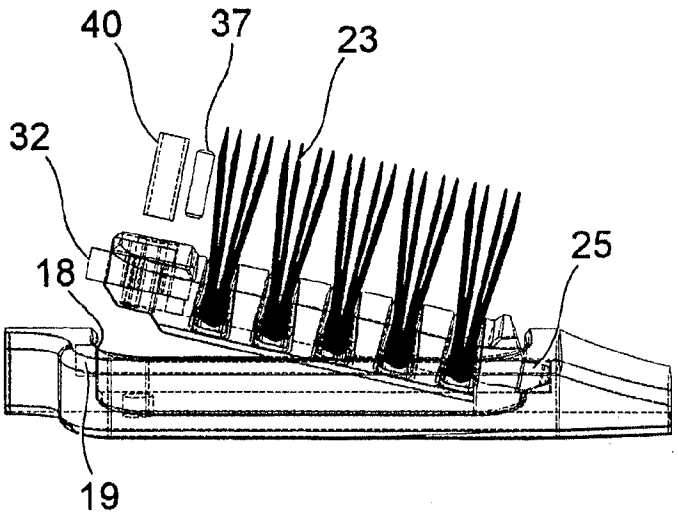
FIG. 4 is a side view of a cleaning element body, and a cleaning element partially inserted with one edge forming an inter-fitting engagement with the cleaning element body.
Figure 3:
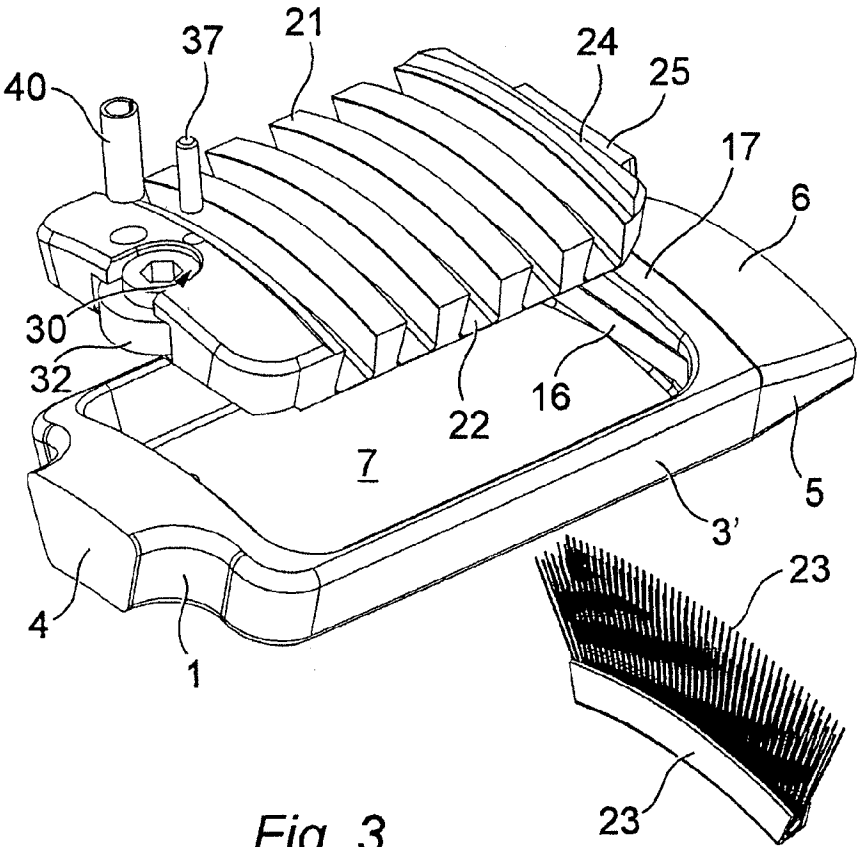
FIG. 3 is an exploded perspective view from above and to one side of the cleaning element body of FIG. 1 in a further stage of assembly with a fastener component installed in an edge projecting configuration, and a brush segment adjacent for insertion into the cleaning element.
Figure 5:
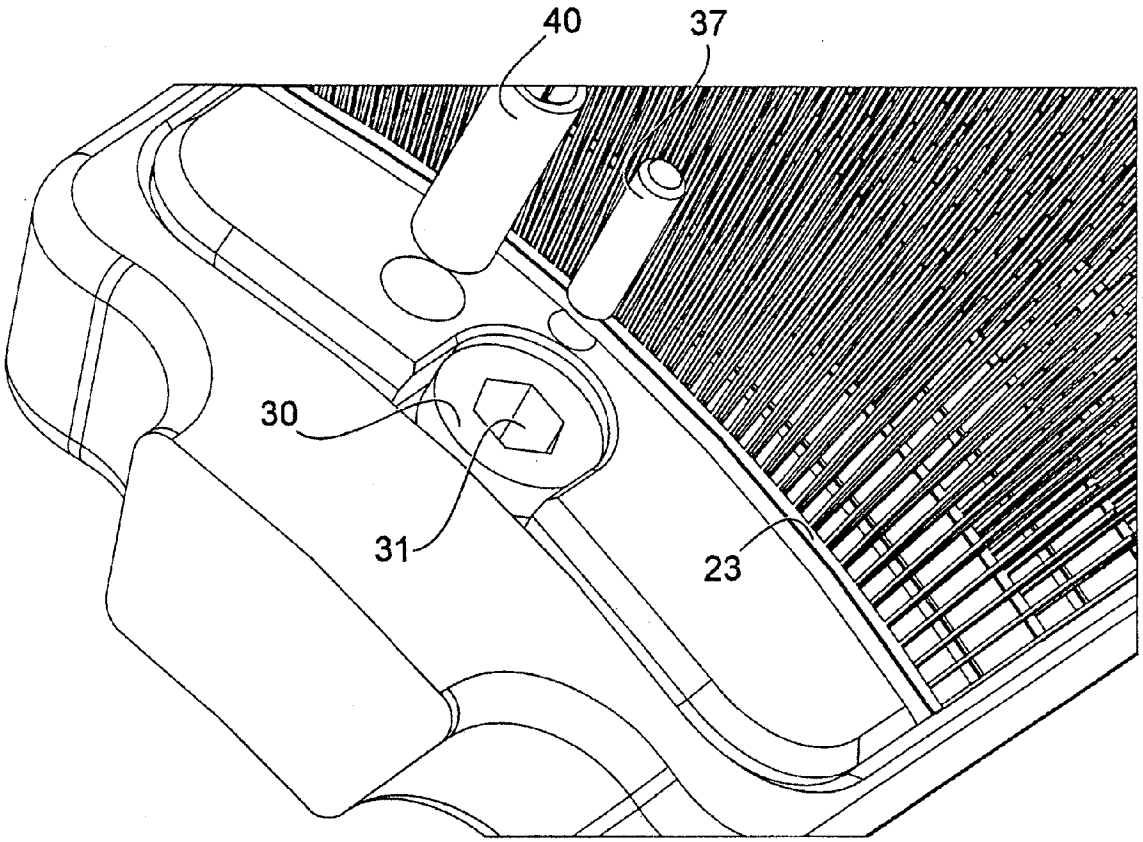
FIG. 5 is an enlarged partial view of a cleaning element as shown in FIGS. 1 to 4 illustrating detail of the exposed driving socket of a fastener component in a recess in the cleaning element that is used to rotationally align the fastener component to receive roll and shear fastener pins presented above the component.
Figure 6:
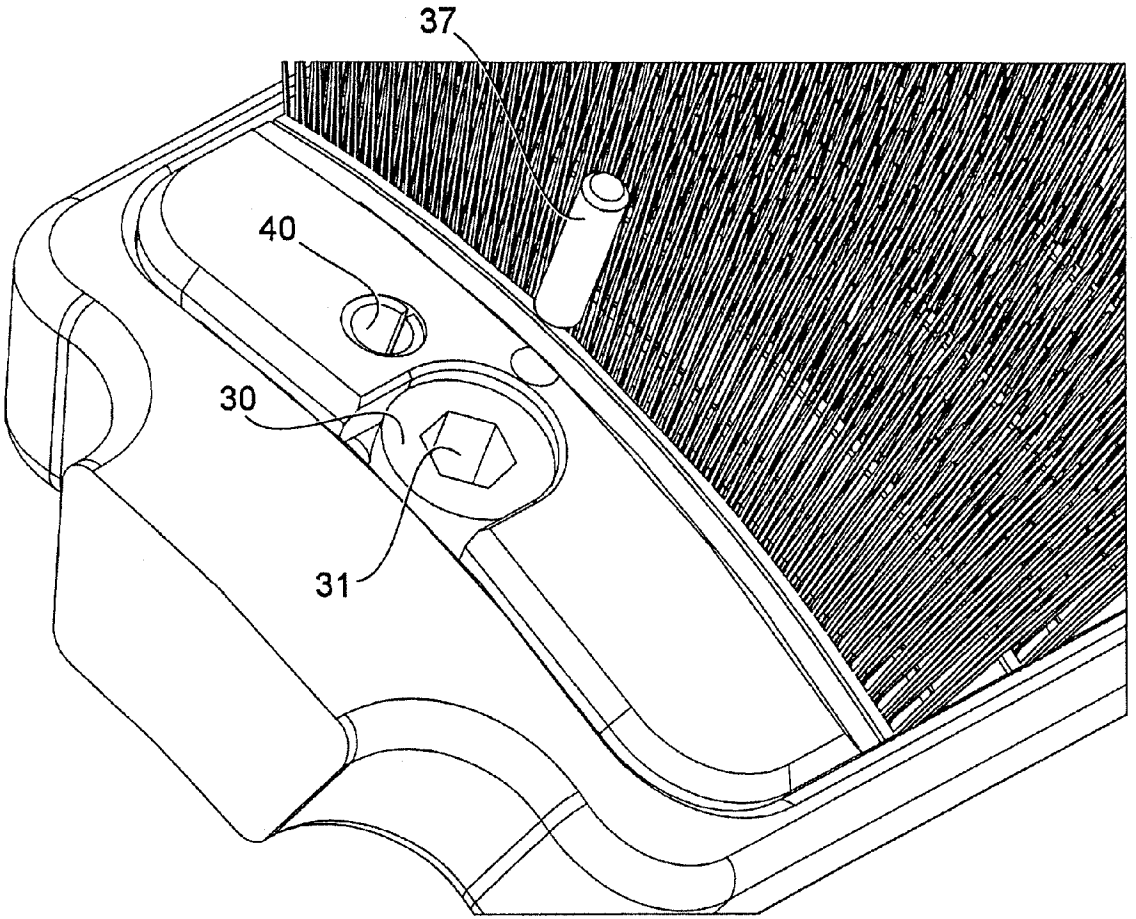
FIG. 6 is an enlarged partial view of a cleaning element as shown in FIG. 5, illustrating full insertion of the roll pin, with shear fastener pin presented above.
Figure 7:
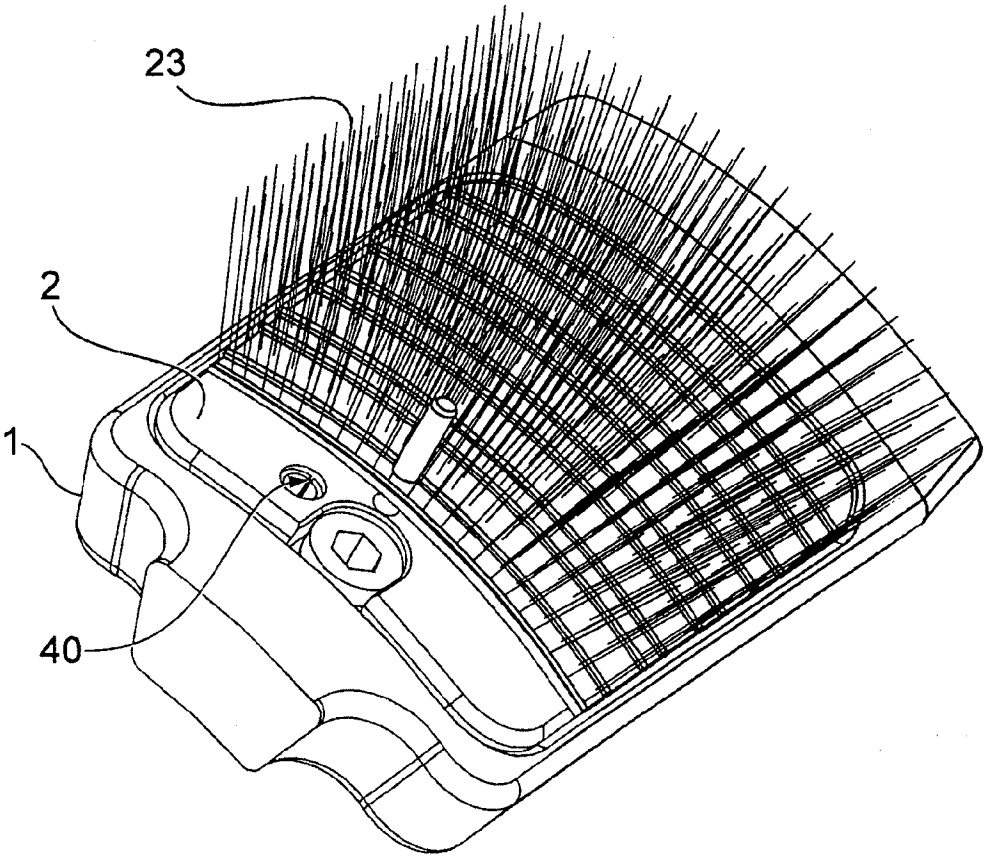
FIG. 7 is a perspective view of the whole cleaning element shown in FIG. 6 prior to insertion of a shear fastener pin to inhibit movement of the fastener component within the recess in the cleaning element and thereby retain the cleaning element seated within the tool body.
Figure 8:
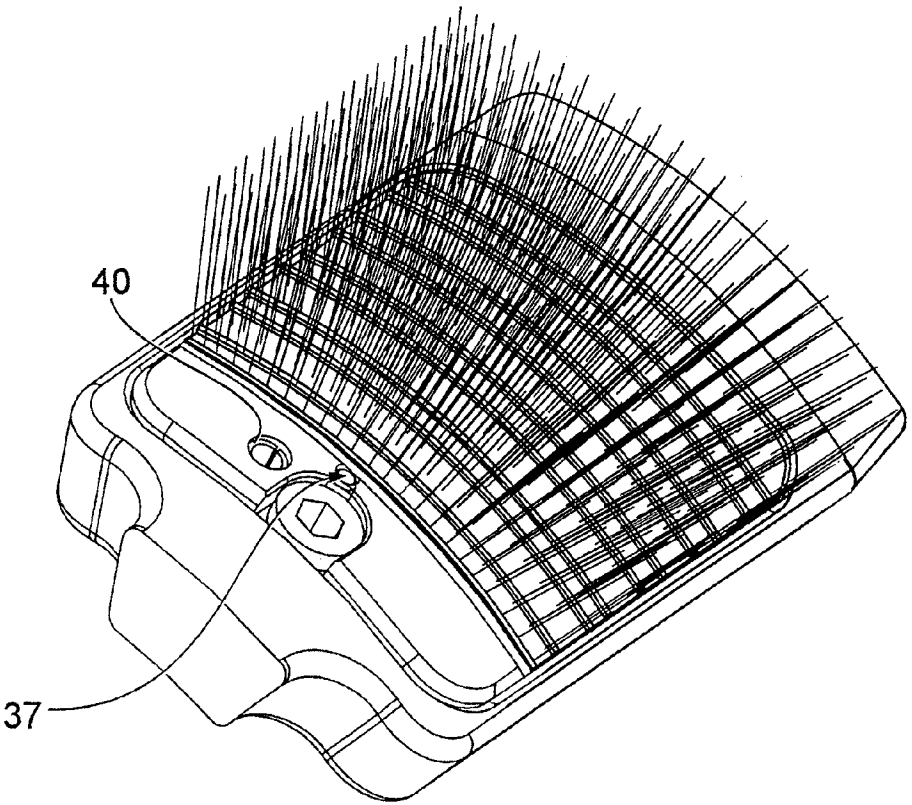
FIG. 8 is a perspective view of the whole cleaning element shown in FIG. 7 after insertion of a shear fastener pin to inhibit movement of the fastener component within the recess in the cleaning element and thereby retain the cleaning element seated within the tool body.
Figure 9:
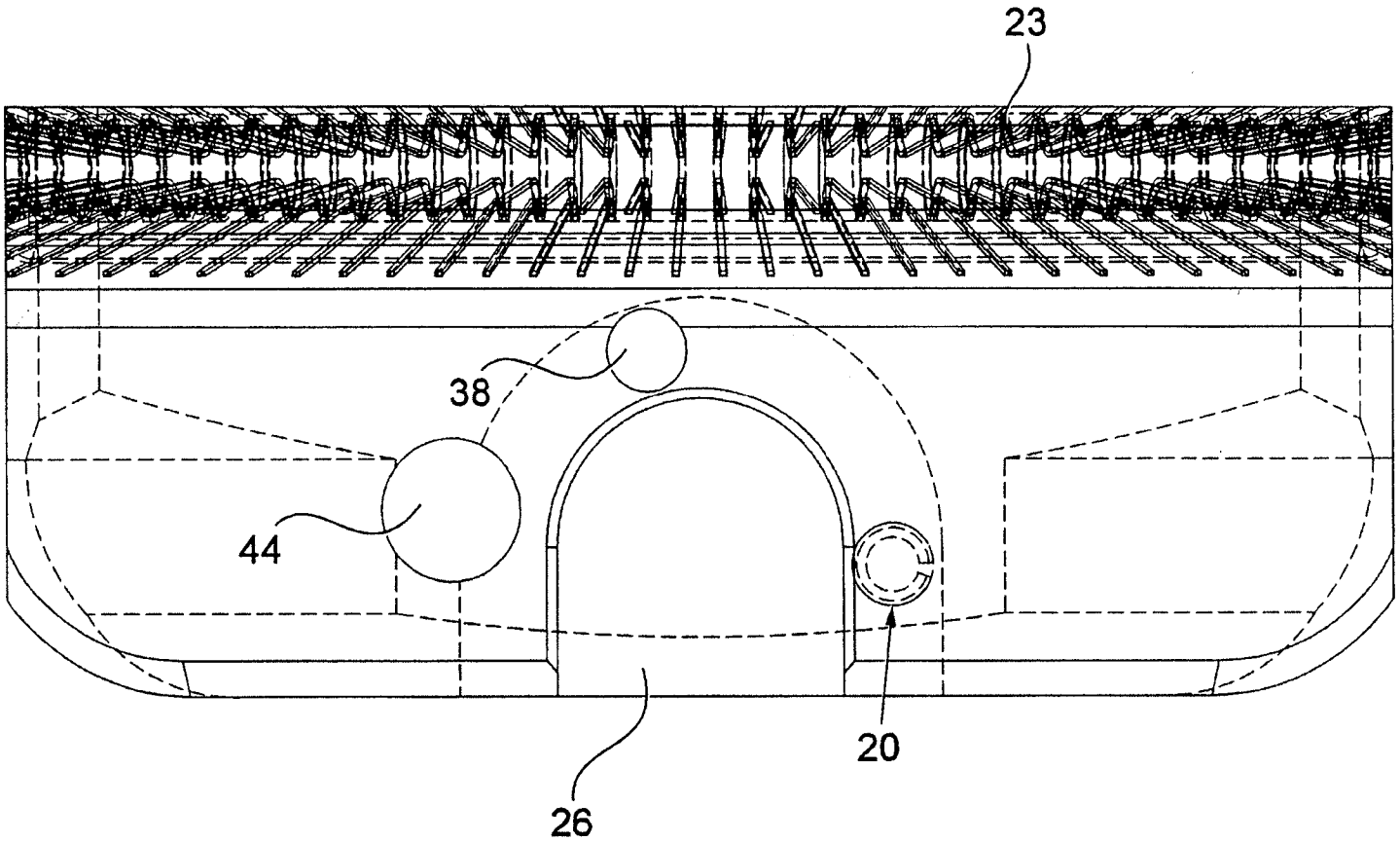
FIGS. 9 to 15 present in succession a storyboard illustration of assembly of the quick release fastening, particularly with respect to insertion, rotation and locking of the fastening component within a recess of the cleaning element in a selected configuration.
Figure 10:
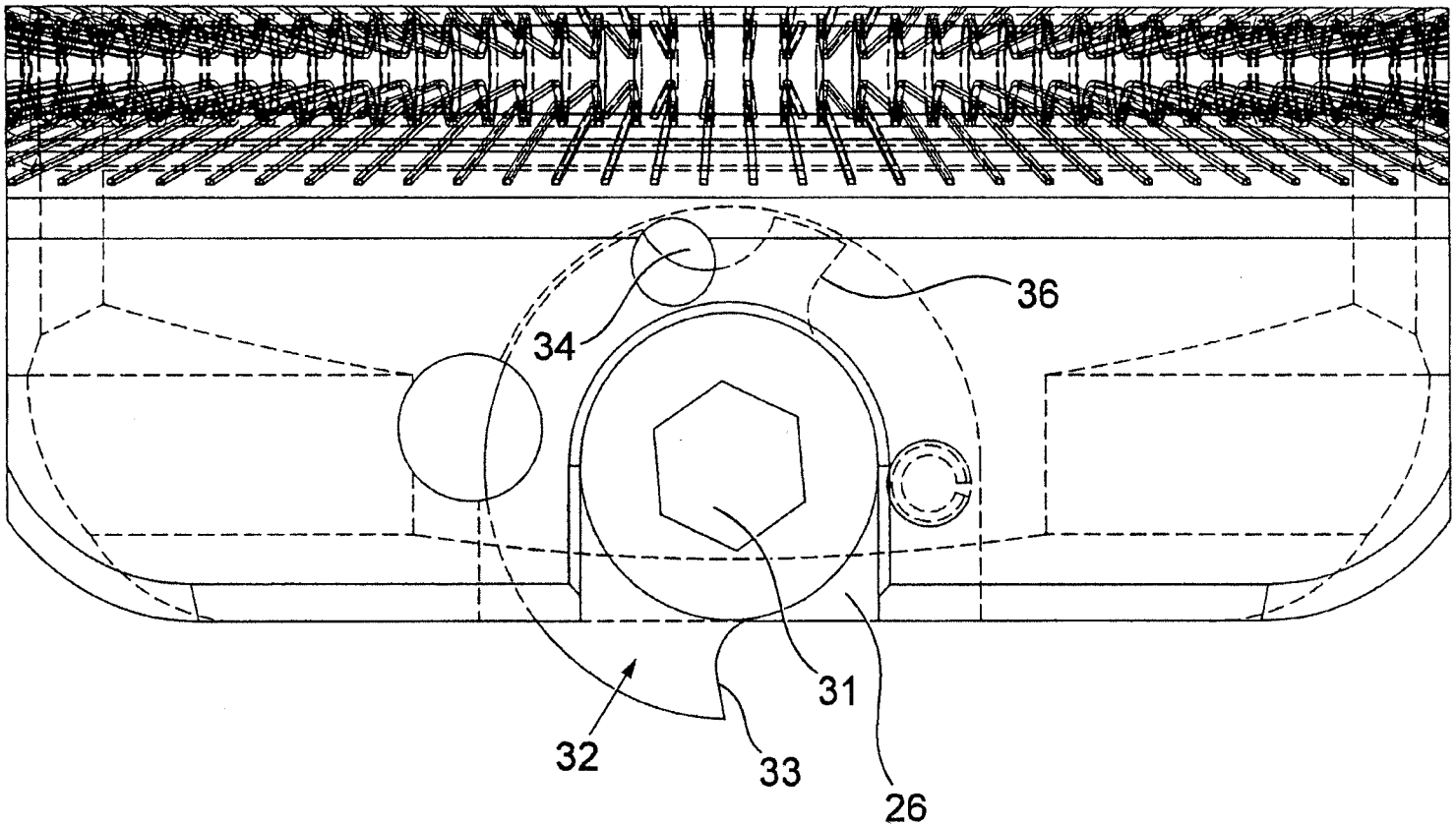
Figure 11:
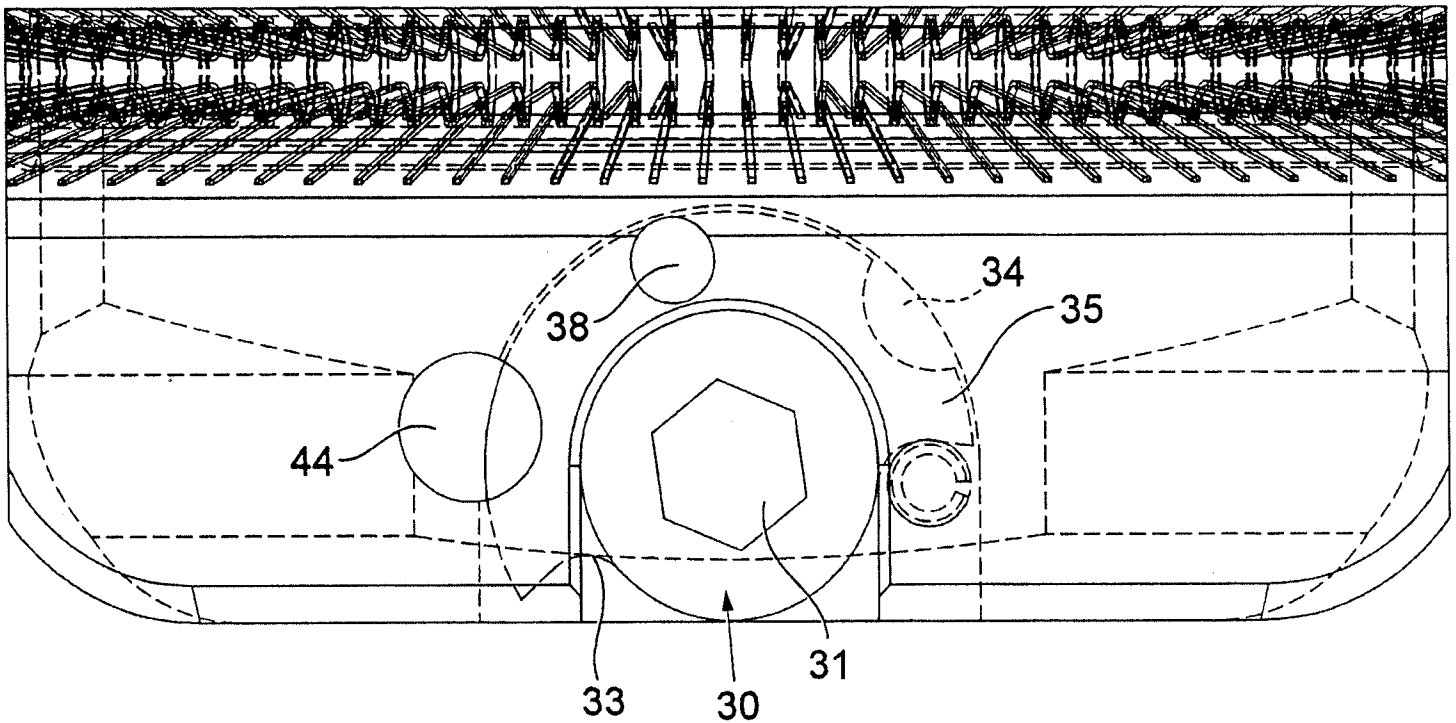
Figure 12:
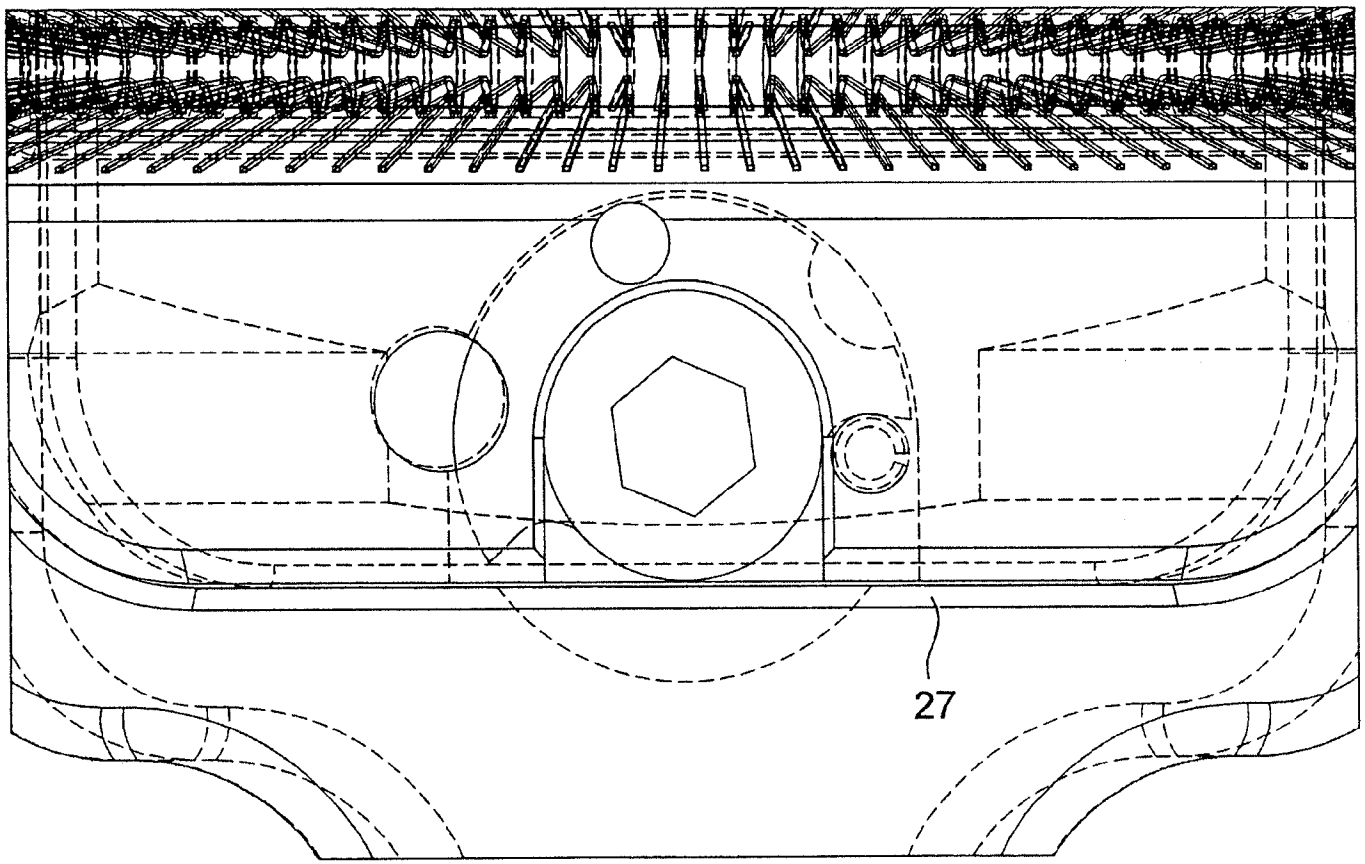
Figure 13:
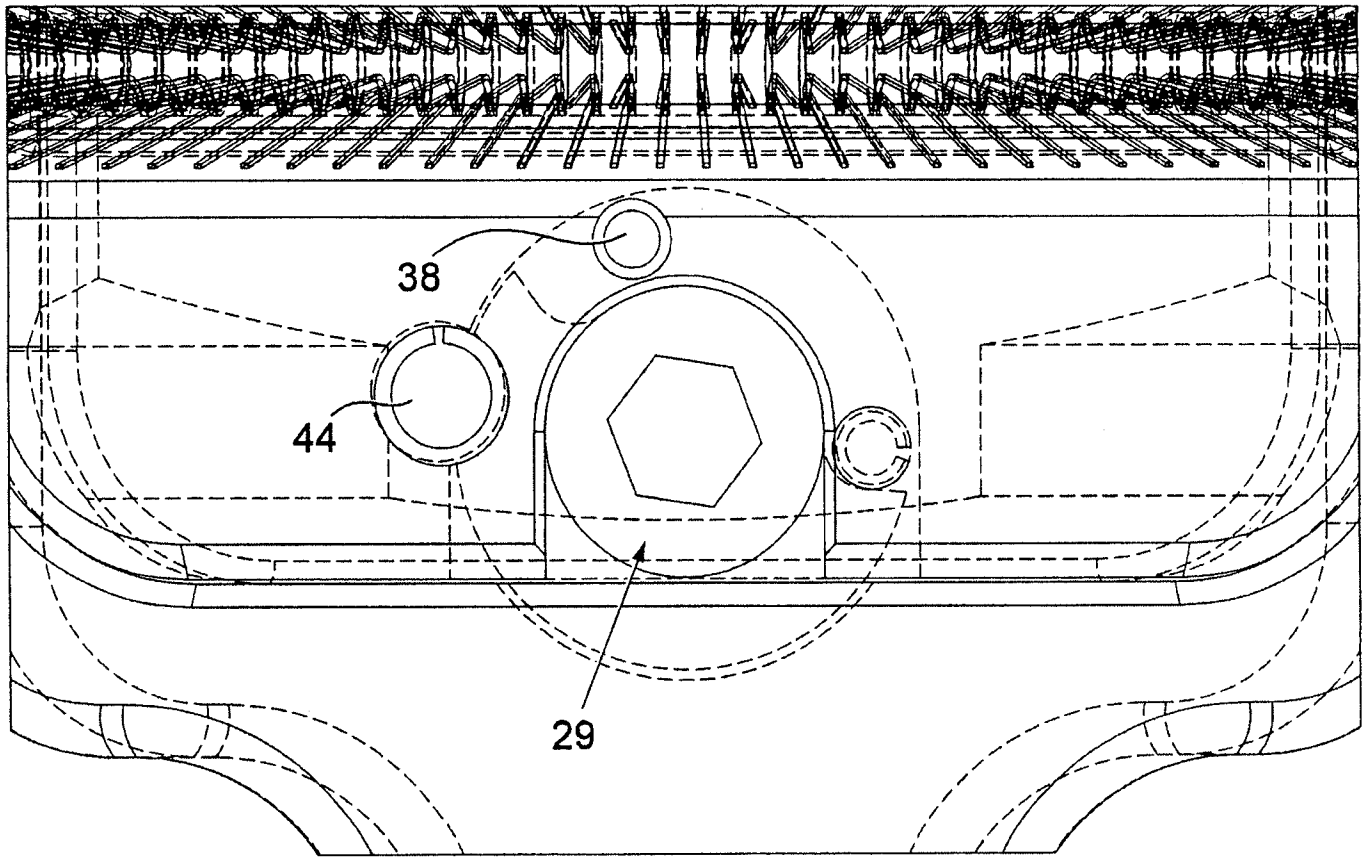
Figure 14:
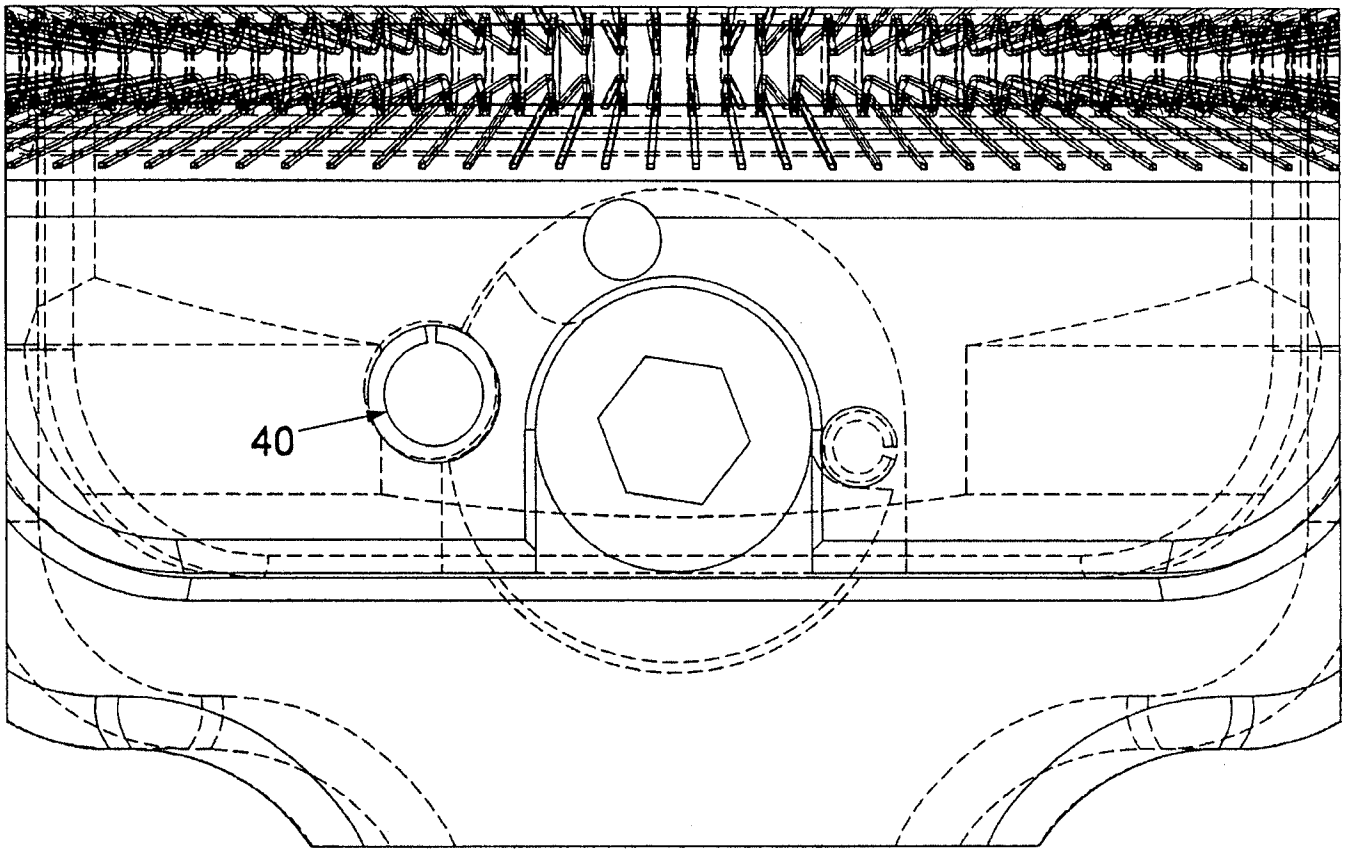
Figure 15:
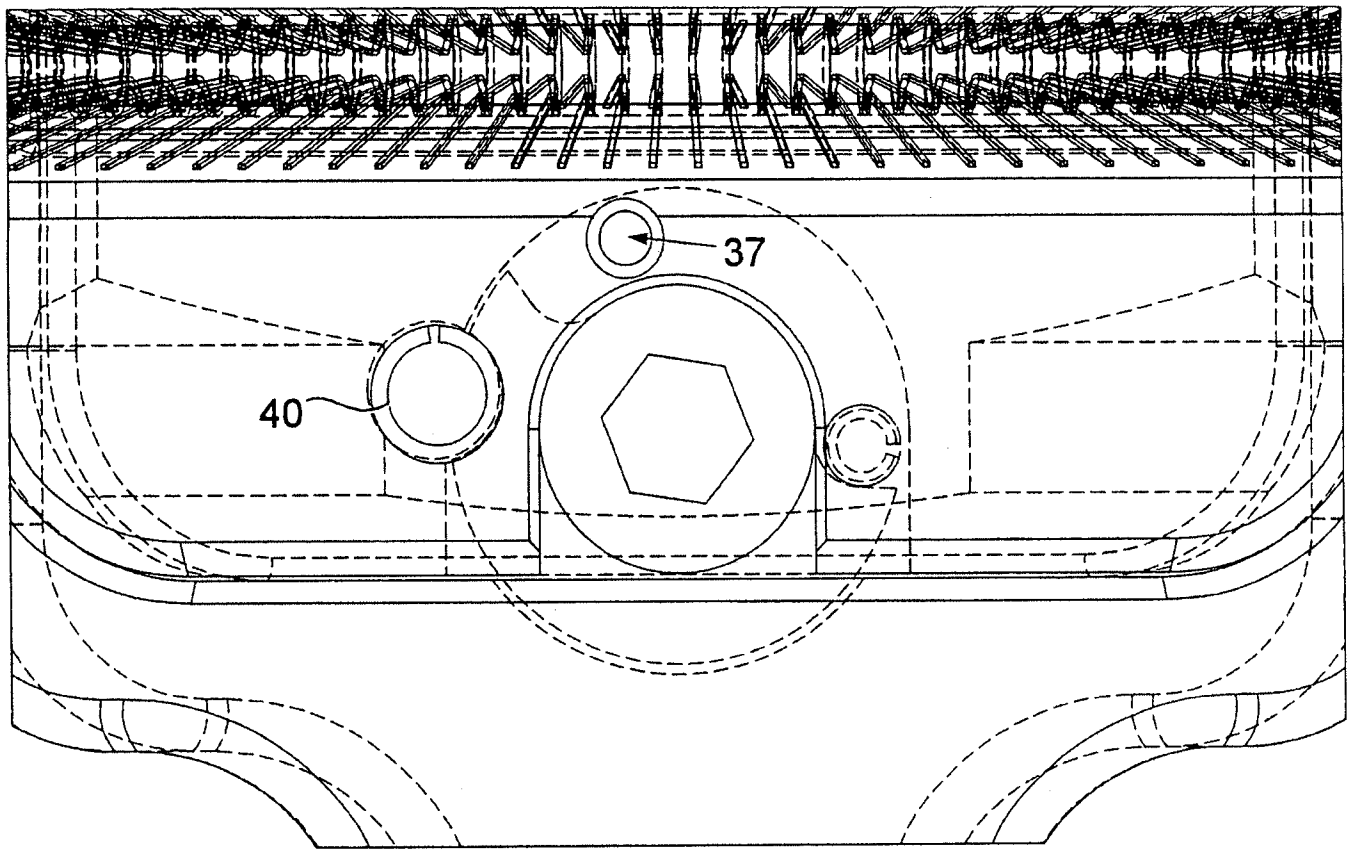
Figure 16:
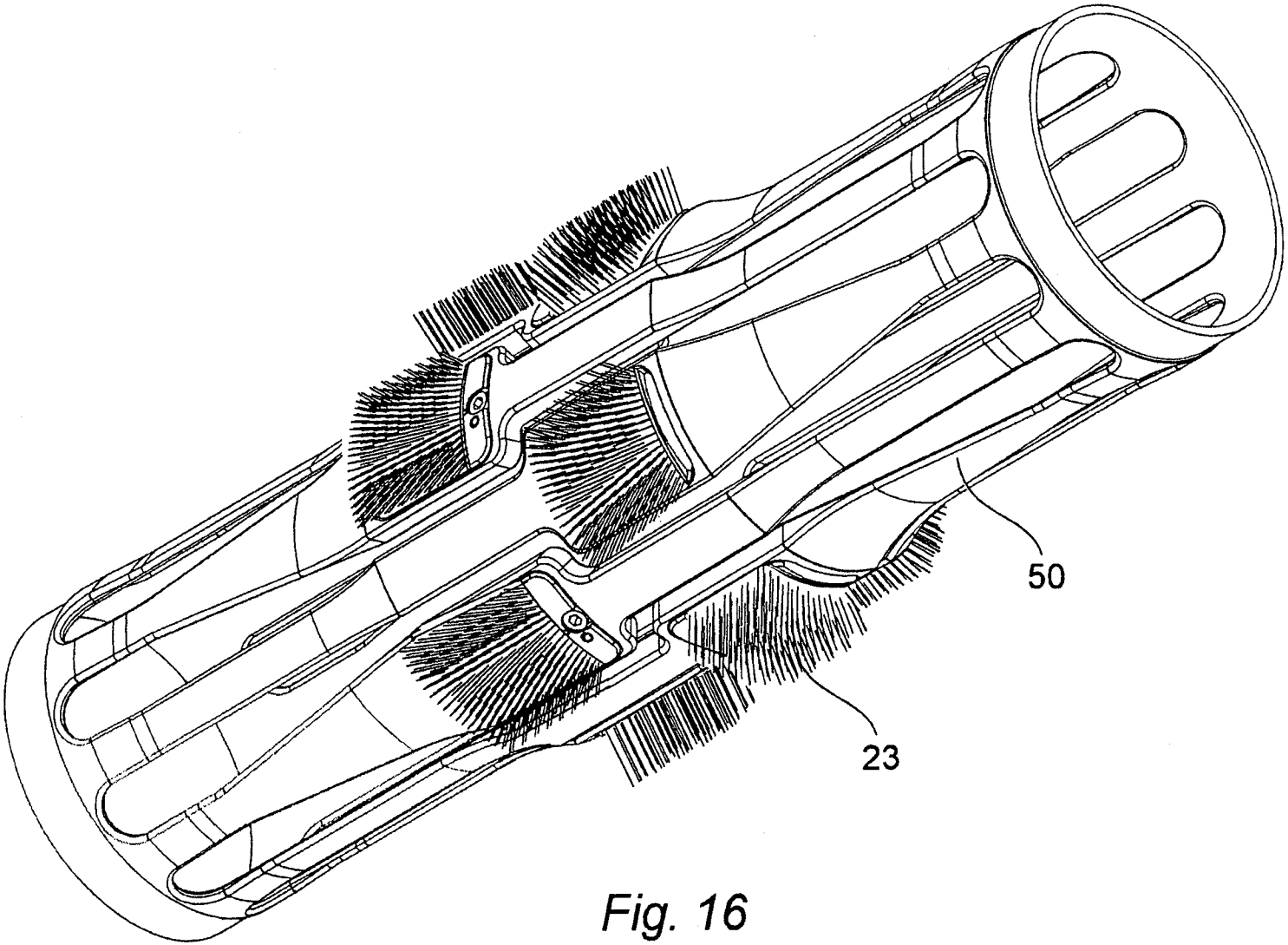
FIG. 16 shows perspective view from above and to one side a typical lantern assembly with radially spaced arrays of bristle elements within tool pad bodies mounted upon the lantern.

A plurality of brush segments 23 are provided for insertion into slots 22 in the cleaning element 2, to provide a brush pad assembly as illustrated in FIG. 4 and FIGS. 7 and 8.

Turning to FIGS. 9 to 15 a method of assembly of the cleaning tool is illustrated.

Presenting the cleaning element 2 with access to the recess 26 in edge 27, a roll pin 20 is pushed into a hole 42 provided for that purpose in the bottom of the cleaning element. That roll pin serves as a limit stop for rotational positioning of the fastening component 29 to be inserted in the recess 26.

The fastening component 29 is then properly presented to align with the recess 26 and pushed in so that the core 30 sits in a rotational position within the lip 28, and the flange 32 is at least partially positioned within the recess 26. A protruding part of the flange may be repositioned by turning of the fastening component 29 to a suitable extent, especially such that the concave surface 36 contacts the roll pin 20.

The cleaning element 2 with hidden flange part can now be properly offered at an angle to the recess 7 in the body 1 such that leading edge 24 presents tongue 25 to groove 16 in end wall 17 to provide an inter-fitting engagement therewith to the extent that the cleaning element when seated flush in the recess 7 cannot be lifted vertically out of its seated position without again tilting the element.

After the element is properly seated in the recess 7, the fastening component 29 is then rotated back to allow the flange 32 to re-emerge from the recess to provide a projection from trailing edge 27, which engages the groove 19 in the end wall 18 of the body 1.

Further roll pin 40 is then inserted in a hole 44 provided for that purpose in the cleaning element upper surface, to maintain the fastening component 29 in its projecting configuration.

The shear pin is then also inserted in a hole 38 for that purpose also located in the upper surface of the cleaning element and passing through same to inhibit the fastening component with respect to full rotation out of the recess, even if roll pin 40 is removed, and thereby ensure that the cleaning element remains flush within the recess 7 of the body 1.

Variants of the embodiment described would permit different shapes or sizes of recess, whilst the illustrated flange may be substituted by a series of spaced tabs for the same purpose of insertion into a corresponding recess to interfere with any action to lift the cleaning element either by a person or by jarring or the like heavy contact with a formation or casing surface.

The work surface of the cleaning element may comprise replaceable segments which are adapted to scrape, scour, swab, wipe, brush or offer a combination of such functionalities.

In application of the invention to assemble a cleaning tool, the following routine is suitable.

An appropriately recessed tool body 1 is provided with at least one removable cleaning element 2, and a rotatable fastener component 29 is arranged into a first configuration in which the flange 32 is turned into the recess 26, so that the flange 32 does not project from the cleaning element. Use of a roll pin 20 in conjunction with curved surface indent 36 on the flange 32 allows accurate positioning of the flange by presenting a limit stop when the flange is inserted into the recess and then sufficiently turned.

The removable cleaning element 2 is inserted into the tool body by presenting an edge 24 of the element to the body and forming an inter-fitting relationship with the tool body by engagement of the tongue 25 thereof into the groove 16 in the end wall in the body 1. Then the element is seated upon the tool body whereupon the fastener component 29 is juxtaposed and aligned with groove 19 in the sidewall 18 of the body 1. The fastener component may then be turned to its outwardly facing configuration in which the projecting flange 32 engages with the groove 19 to form an inter-fitting connection with the tool body that prevents the cleaning element 2 being unseated or lifted out of the opening 7. Use of a further roll pin 40 in conjunction with curved surface indent 34 on the flange 32 allows accurate re-positioning of the flange by presenting a limit stop when the flange is turned back sufficiently.

Finally, a shear fastener pin 37 is inserted to inhibit further movement of the fastener component.

When it is desired to disassemble the tool, the roll pin 40 is removed, and the fastener component 29 is rotated by use of a suitable driving tool until the surface 36 abuts the shear fastener pin 37, whereupon application of additional force through the driving tool causes the shear fastener pin 37 to yield. At this point the fastener component can be turned fully into a recessed position where the flange 39 is hidden and no longer interfering with movement of the cleaning element out of the plane of the opening 7 by being freed from the groove 19 in end wall 18 of the tool body.

Substitute cleaning elements can then readily be mounted upon the tool body by repeating the assembly steps described above.

A downhole tool in which the invention may be implemented is suitably a sub body (not shown) adapted to be connected to a tubular workstring, the body being provided with non-rotating stabiliser sleeves and a non-rotating lantern 50 adapted for scraping or brushing by insertion of the afore-described cleaning element—tool body assemblies.

The cleaning steps may be conducted as normal whilst the drill string is being reciprocated within the wellbore. Optionally, the cleaning steps may be repeated whilst the rotating drill string is reciprocated at a controlled rate.

Various modifications may be made to the invention herein described without departing from the scope thereof.

The invention claimed is:

1. A downhole clean-up tool comprising:

a tool body adapted to receive a cleaning element, a cleaning element configured to be mounted upon the tool body, and a quick-release fastening comprising:

a movable fastener component for retaining the cleaning element upon the tool body, wherein the cleaning element has a recess adapted to receive the movable fastener component; and a shearable fastener for holding the movable fastener component in position, wherein the movable fastener component is adapted to shear the shearable fastener for release of the cleaning element, and wherein the movable fastener component is mounted for rotation within the recess, so that by appropriate rotation of the movable fastener component a projecting edge of the movable fastener component may be caused to emerge from or retreat within the recess.

2. The downhole clean-up tool as claimed in claim 1, wherein the quick-release fastening comprises an asymmetric fastener component that has a shape that provides for at least two configurations when positioned with the cleaning element, such that in a first configuration, an edge of the component projects from the cleaning element, and in another configuration that edge does not project from the cleaning element.

3. The downhole clean-up tool as claimed in claim 1, wherein the fastener component is adapted to receive a driving tool.

4. The downhole clean-up tool as claimed in claim 1, wherein the positioning of the fastener component with respect to the cleaning element is selectively retained in a predetermined configuration by use of retaining means.

5. The downhole clean-up tool as claimed in claim 4, wherein the retaining means comprises one or more removable roll pins.

6. The downhole clean-up tool as claimed in claim 4, wherein the positioning of the fastener component is locked in a functional position by use of the shear fastener to inhibit movement of the fastener component by way of a press or interference fit therewith.

7. The downhole clean-up tool as claimed in claim 1, wherein the cleaning element is configured to have an edge portion remote from the quick release fastening that is adapted to inter-fit with a corresponding part of the tool body.

8. The downhole clean-up tool as claimed in claim 7, wherein the cleaning element and the tool body cooperate to inter-fit by means of a tongue and groove edge fixing configuration.

9. The downhole clean-up tool as claimed in claim 1, wherein at least one work surface of the cleaning element is curved.

10. The downhole clean-up tool as claimed in claim 1, wherein at least one work surface of the cleaning element comprises replaceable segments.

11. The downhole clean-up tool as claimed in claim 1, wherein at least one work surface of the cleaning element is adapted to scrape, scour, swab, wipe, brush or offer a combination of such functionalities.

12. The downhole clean-up tool as claimed in claim 1, wherein at least one work surface of the cleaning element comprises scraper blades or bristles.

* * * * *